United States Patent [19]

Isenberg

[11] 4,187,905

[45] Feb. 12, 1980

[54] ATTACHABLE PIPE RADIATOR

[76] Inventor: Raymond C. Isenberg, R.R. #1, Box 89, (Covedale) Williamsburg, Pa. 16693

[21] Appl. No.: 851,460

[22] Filed: Nov. 14, 1977

[51] Int. Cl.[2] ..... F28F 1/20

[52] U.S. Cl. ..... 165/181; 165/182; 29/157.3 A

[58] Field of Search ..... 165/181, 182, 184, DIG. 2; 29/157.3 A, 157.3 AH

[56] References Cited

U.S. PATENT DOCUMENTS

| | | | |
|---|---|---|---|
| 2,372,795 | 4/1945 | Rodeck | 165/184 |
| 2,656,158 | 10/1953 | Hodson et al. | 29/157.3 A |
| 3,083,662 | 4/1963 | Zeidler | 29/157.3 A |
| 3,397,440 | 8/1968 | Dalin | 165/181 |

FOREIGN PATENT DOCUMENTS

| | | | |
|---|---|---|---|
| 1104979 | 4/1961 | Fed. Rep. of Germany | 165/182 |
| 433276 | 12/1911 | France | 165/DIG. 2 |
| 561785 | 6/1944 | United Kingdom | 165/184 |
| 800265 | 8/1958 | United Kingdom | 165/184 |

*Primary Examiner*—Ronald H. Lazarus
*Assistant Examiner*—Magdalen Moy
*Attorney, Agent, or Firm*—Thomas E. Sterling

[57] ABSTRACT

A radiator device adapted for attachment to a radiator pipe, comprising a mounting base wrapped about the radiator pipe and secured thereto by wire fastenings; a plurality of outwardly disposed radiating fins circularly positioned about said mounting base and extending outwardly therefrom. This radiating device is adapted to be installed upon any size flue pipe extending from a furnace to a chimney to transmit flue pipe heat to the surrounding atmosphere.

8 Claims, 10 Drawing Figures

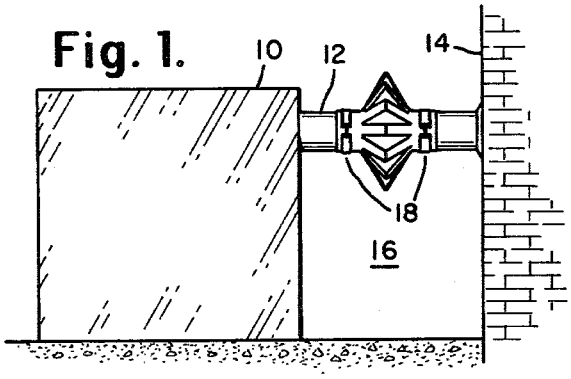
Fig. 1.
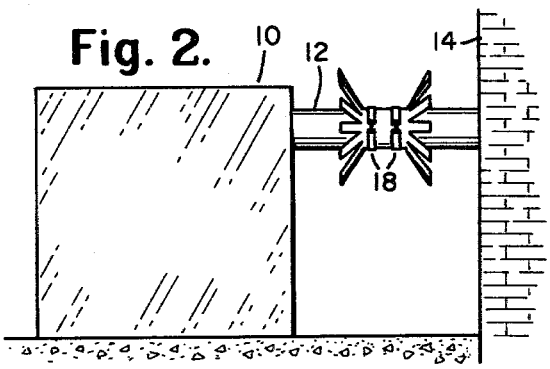
Fig. 2.
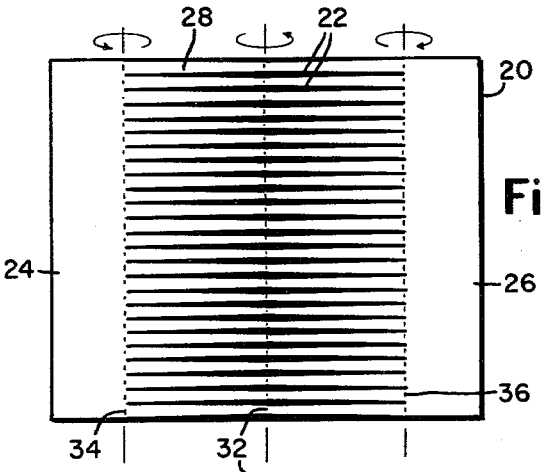
Fig. 3.
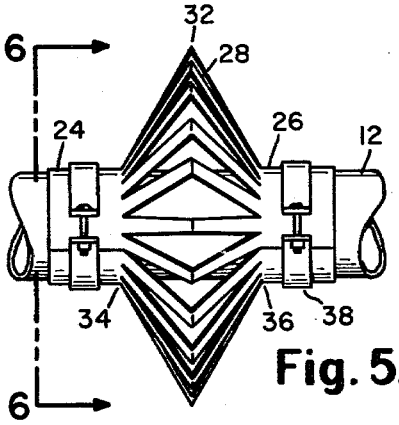
Fig. 5.
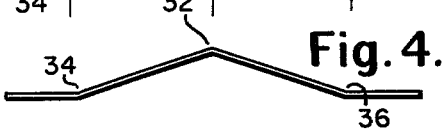
Fig. 4.
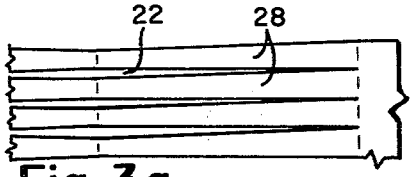
Fig. 3a.
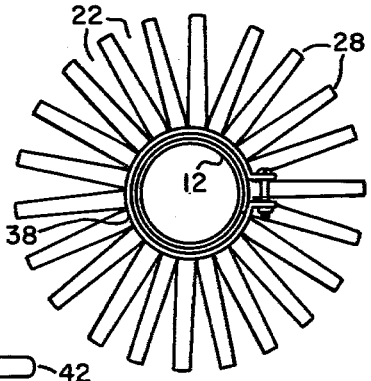
Fig. 6.
Fig. 7a.
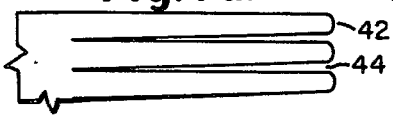
Fig. 7.
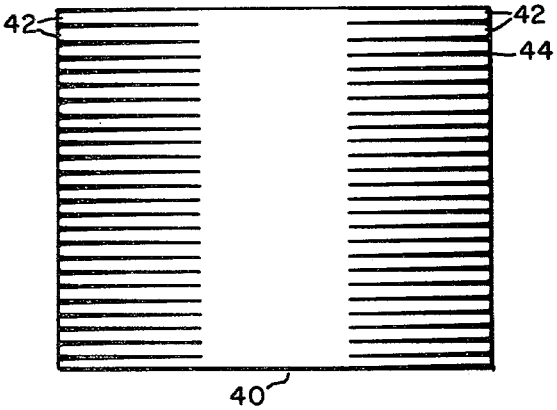
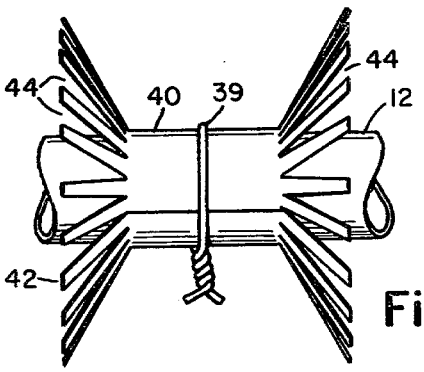
Fig. 8.

ATTACHABLE PIPE RADIATOR

This invention relates to adapting radiating devices and in particular to radiating devices adaptable for attachment upon a hot flue pipe leading from a furnace or the like.

Furnaces used to heat different houses or other buildings frequently have flue pipes leading from the furnace box to the chimney to transport furnace smoke and fumes out of the furnace area. These flue pipes transmit a large quantity of heat from the furnace area to the chimney. This heat to a large extent is lost. In this era of conservation, it is desirable to recapture some of this lost heat and transmit it to the atmosphere in the cellar in which the furnace is located, thus warming the area. This invention provides a simple inexpensive mechanism for installation upon the hot flue pipe whereby the lost heat is radiated into the adjoining cellar area.

Basically the invention is comprised of a sheet of aluminum, or other conducting metals, having a plurality of strips cut in the end or center portion thereof. When the metallic sheet is wrapped around the flue pipe the plurality of strips are outwardly diposed, forming a series of fin radiators which will transmit the heat from the hot flue pipe to the atmosphere surrounding the radiator. In this way the area about the furnace is warmed with heat that would otherwise have been transmitted out the chimney.

This invention is comprised of two modifications. One modification utilizes outwardly disposed fins positioned on either side of a base element. A second modification utilizes outwardly disposed fins positioned between two base elements attached to the hot flue pipe. The invention is adjustable to any size or configuration of flue pipe since it will wrap around the pipe of almost any diameter. The fins of the invention are tapered as they extend outwardly.

An object of this invention is to provide for a simple attachable radiating device.

Another object of this invention is to provide a radiator that may be easily manufactured from a piece of sheet metal.

Still another object of this invention is to provide a radiator that may be easily attached to pipes of any diameter or configuration.

Yet another object of this invention is to provide a radiating device that may be attached to flue pipes of furnaces.

These and other objects of this invention are more fully set forth in the accompanying Specification and Claims, in which:

FIG. 1, is a side view of the invention attached to a flue pipe leading from a furnace to a chimney.

FIG. 2, is a side view of a modification of this invention attached to a flue pipe leading from a furnace to a chimney.

FIG. 3, is a top view of the invention as cut out of a single sheet of sheet metal.

FIG. 3A, is an enlarged view of a section of FIG. 3, showing the diamond shaped cuts separating the fins.

FIG. 4, is a side view of the invention of FIG. 3.

FIG. 5, is a side view of the invention installed upon a flue pipe by means of two clamps.

FIG. 6, is a view of the invention taken along lines 6—6 of FIG. 5.

FIG. 7, is a top view of a modification of the invention as cut out of a single sheet of sheet metal.

FIG. 7A, is an enlarged view of a section of FIG. 7, showing the V-shaped cuts between the fins of the invention.

FIG. 8, is a modification of the invention installed on a flue pipe by means of a twisted wire.

Referring now to FIG. 1, 10 represents a furnace having a flue pipe 12 attached to a chimney 14. The invention, an attachable pipe radiator 16 is installed upon flue pipe 12 by means of two clamps 18. Referring now to FIGS. 3, 3A and 4, 20 represents a rectangular piece of metal sheet having a plurality of parallel diamond shaped slits 22 extending down the mid-portion of metal sheet 20 so as to form a plurality of fins 28. Diamond shaped slits 22 provide a spacing between the fins 28 to allow fins 28 to move past each other without touching. Mounting bases 24 and 26 are positioned on either side of the plurality of parallel diamond shaped slits 22. Mounting bases 24 and 26 are comprised of solid sheet metal of metal sheet 20 unperforated or slit. Metal sheet 20 is generally comprised of aluminum because of its lightness and flexibility, although other types of material may be used such as iron, galvanized iron, copper, zinc, and the like. The mid-portion of metal sheet 20 is elevated as may be seen on FIG. 4.

In operation, metal sheet 20 is pressed inwardly from mounting bases 24 and 26 so as to cause fins 28 to elevate in the manner indicated in FIG. 4. Mounting bases 24 and 26 are then wrapped around flue pipe 12 with fins 28 elevated and extending around flue pipe 12. A plurality of elongated fins 28 rise forming a circular cone shape. In practice, elongated fins 28 are creased at apex 32 and base lines 34 and 36. Mounting bases 24 and 26 are then wrapped tightly around flue pipe 12 and secured to flue pipe 12 by clamps 38.

Clamps 38 may be replaced by a wire wrapped about the bases and twisted to form a tight fit. This will aid in heat transfer from the flue pipe 12 to mounting bases 24 and 26. The heat will then be transmitted to fins 28 which will radiate it into the surrounding air, to warm it. The large surface area of fins 28 will provide a most efficient radiating surface.

Referring now to FIGS. 2, 7, 7A and 8, there may be seen a modification of the invention having a single mounting base 40 on either side of which are positioned a plurality of external fins 42 each having a V-shaped slit 44 therebetween. The V-shaped slits 44 allow the fins 42 to be laterally moved without rubbing against or interfering with one another.

In operation, mounting base 40 is wrapped tightly around flue pipe 12 (FIG. 8) and secured thereto by means of a piece of malleable wire 39. Wire 39 is wrapped tightly around mounting base 40 and twisted so as to press mounting base 40 securely against flue pipe 12. In practice, two or more wires 39 may be wrapped around mounting base 40 to secure the device. Wire 39 may also be used to secure attachable pipe radiator 16 in place of clamps 18. Other fastening means may also be utilized without departing from the spirit of the invention.

After mounting base 40 is wrapped around the flue pipe 12, the fins 42 are raised from the surface of the flue pipe 12 until they extend at an angle thereto (see FIG. 8). Angles of from 5° to 175° have been found most satisfactory with angles of about 45° preferred.

In operation, the heat from flue pipe 12 is transmitted to mounting base 40 and from thence to fins 42 from where it is radiated into the surrounding atmosphere.

The large surface area of fins 42 allows extensive radiation and efficiency of the device.

As may be seen, either modification of the above invention is easily installed and removed from any size of pipe and will serve as a readily installed, efficient radiating device. It is within contemplation that this invention may be installed on any size or shape of pipe including such as rectangular, square, diamond shapes, and the like and that the invention may be used as a heat absorbing mechanism as well as a heat transmitting device.

I claim:

1. A portable radiator device adapted to be adjustably attached to a thin-walled flue pipe, consisting of a single sheet of thin metal having a plurality of parallel diamond-shaped slits centrally positioned therein, comprising in combination:

a thin-walled flue pipe;

two mounting bases adapted to wrap circumferentially about said flue pipe perpendicularly to the mid-line of said flue pipe, said mounting bases comprised of the end portions of said single sheet of thin metal;

a plurality of fins extending outwardly and continuously between said mounting bases, said fins having an inwardly disposed V-shaped space therebetween;

securing means extending circumferentially about said mounting bases, perpendicularly to the mid-line of said flue pipe and adapted to secure said mounting bases to said flue pipe.

2. The combination as claimed in claim 1 in which said fins extending have a V-shape.

3. The combination as claimed in claim 2 in which said fins are upwardly creased at the intersection with said mounting bases, downwardly creased at their mid-point between said mounting bases and extend continuously between said mounting bases.

4. The combination as claimed in claim 3 in which said securing means are comprised of a wire wrapped about said mounting bases perpendicular to the mid-line of said flue pipe.

5. The combination as claimed in claim 3 in which said securing means is comprised of, in combination:

a circular band positioned circumferentially around each mounting base, said band being perpendicular to the mid-line of said flue pipe;

two flanges attached to the extremities of said band;

a screw extending through said two flanges;

a nut screwably attached to said screw and adapted to draw said two flanges together.

6. A portable radiator device adapted to adjustable attachment to a thin-walled flue pipe, said device consisting of a single sheet of metal having a plurality of parallel diamond-shaped slits positioned on the end portions of said sheet and having a base section therebetween, comprising in combination:

a thin-walled flue pipe;

a single mounting base comprised of said base section adapted to wrap circumferentially about said flue pipe, perpendicular to the mid-line of said flue pipe;

a plurality of V-shaped fins extending outwardly from said mounting base, said fins having an inwardly disposed V-shaped space therebetween;

securing means extending circumferentially about said mounting base, perpendicular to the mid-line of said flue pipe and adapted to clamp said mounting base to said flue pipe.

7. The combination as claimed in claim 6 in which said securing means is comprised of, in combination:

a circular band positioned circumferentially around said mounting base, perpendicular to the mid-line of said flue pipe;

two flanges attached to the extremities of said band;

a screw extending through said two flanges;

a nut screwably attached to said screw and adapted to draw the said two flanges together.

8. The combination as claimed in claim 6 in which said securing means is comprised of a wire circumferentially wrapped about said mounting base, perpendicular to the mid-line of said flue pipe.

* * * * *